United States Patent [19]

Wiedermann

[11] 3,992,995

[45] Nov. 23, 1976

[54] SPEED CONTROLLED SECOND EVENT LAUNCHER

[75] Inventor: Arne H. Wiedermann, Chicago Heights, Ill.

[73] Assignee: The United States of America as represented by the Secretary of the Air Force, Washington, D.C.

[22] Filed: Sept. 4, 1975

[21] Appl. No.: 610,465

[52] U.S. Cl. ..... 102/7.2; 102/6; 102/66; 102/90

[51] Int. Cl.[2] ..... F42B 25/00

[58] Field of Search ..... 102/6, 7.2, 34.4, 35.6, 102/37.6, 39, 60, 66, 90, 81, 81.2; 89/1 F

[56] References Cited

UNITED STATES PATENTS

| | | | |
|---|---|---|---|
| 1,791,716 | 2/1931 | Davis et al. | 102/66 X |
| 3,095,814 | 7/1963 | Jansen et al. | 102/34.4 |
| 3,143,965 | 8/1964 | La Pointe | 102/34.4 |
| 3,382,800 | 5/1968 | Biggs, Jr. | 102/90 X |
| 3,570,401 | 3/1971 | Euker | 102/66 |
| 3,596,602 | 8/1971 | Gey | 102/90 |
| 3,596,603 | 8/1971 | Grytlng | 102/90 |
| 3,636,874 | 1/1972 | Gey | 102/90 X |
| 3,713,383 | 1/1973 | Crescenzo et al. | 102/90 |
| 3,730,093 | 5/1973 | Cummings | 102/66 X |
| 3,818,794 | 6/1974 | Mayer et al. | 89/1 F X |

*Primary Examiner*—Harold Tudor
*Attorney, Agent, or Firm*—Joseph E. Rusz; Arsen Tashjian

[57] ABSTRACT

A variable position launcher including a launch tube in which the second event (SE) package is placed. A positioning spring on the explosive side of the SE package urges it toward the muzzle end of the tube which is sealed with a frangible cover. A gas inlet operates to pressurize the muzzle end of the tube and apply a velocity dependent force on the SE package opposite the spring force so that the SE package is accurately positioned within the tube thereby controlling the retrolaunch velocity.

4 Claims, 2 Drawing Figures

SPEED CONTROLLED SECOND EVENT LAUNCHER

STATEMENT OF GOVERNMENT INTEREST

The invention described herein may be manufactured and used by or for the Government for governmental purposes without the payment of any royalty thereon.

BACKGROUND OF THE INVENTION

This invention relates to a liquid fuel-air-explosive (FAE) device and, more particularly, the invention is concerned with providing a second event (SE) explosion within the boundaries of the FAE cloud at the proper time.

The liquid fuel-air-explosive device operates by rapidly dispersing liquid fuel to form the largest detonable cloud possible for the amount of liquid fuel used and subsequently detonating the cloud by means of a high explosive source. The basic fuel-air-explosive (FAE) device includes a liquid fuel container, a burster charge and second event (SE) cloud detonators. Detonation of the burster charge distributes the liquid fuel and SE detonators into what is called the FAE cloud. The SE detonators, in turn, initiate the fuel cloud creating the fuel-air-explosion.

After the dynamic FAE cloud is formed, it must be detonated by exploding an explosive charge or its equivalent within the boundaries of the cloud. This charge is referred to as the SE (second event) charge and the associated dispersal system is called the SE system. The specific requirements for the SE charge, such as its size, delay and spatial position are critical parameters which must be determined in order to provide an FAE device with the proper high explosive source.

The location of the FAE cloud, relative to some reference point such as location of the FAE device at the time the fuzing system is initiated, will depend upon the many variables of the FAE device as well as upon terminal aerodynamic conditions, such as speed and orientation, and upon proximity of the ground plane. A typical cloud will form into a distorted torus shape which has an outer diameter of roughly 60 feet and its thickness may be about 20 feet. The center plane of the cloud may be displaced along the line of flight several tens of feet. The cloud will generally have a central hole along the line of flight of about 10 feet in diameter. Finally, the ground plane will further distort the cloud locally. The position of the FAE cloud at or near its terminal size will be reached about 100 milliseconds after the burster charge is detonated.

The SE system must deliver the SE package or charge to an appropriate position within the cloud such that, when the SE charge detonates, the cloud will detonate in a reliable fashion. Reliability of the placement and performance of the SE package, together with variability of the characteristics of the FAE cloud, requires that a plurality of SE packages are needed. Spatial and time delay requirements indicate that the SE packages will have to be launched from the FAE device with a sideward velocity of the order of 200 fps. The flight velocity which can range from 400 to 1000 fps must be approximately nullified. Thus, the SE packages must be accelerated primarily rearward in a controlled fashion from the FAE device at a velocity approximately equal to the device's flight velocity. Furthermore, this launching process must be accomplished during the period in which the FAE device is exploding. Since large deformation of the FAE device will occur within 1 msec, the SE packages must be launched in such a period of time. Any interaction between these two processes must be considered in the design of the SE system.

The need of a speed controlled second event system becomes apparent as the ranges of the terminal parameters are broadened. It becomes essential to alter the retrolaunch conditions for widely varying terminal velocities and incident angles in order to still deploy at least one SE detonator within the resultant detonable cloud volume. The implementation of a speed control system for the second event task requires first that the magnitude of the flight velocity be adequately sensed and secondly that certain retrolauncher parameters be adjusted so that the desired burst region can be reached. It also is necessary to have available some power source with which to make the needed adjustments. The total pressure which the FAE device possesses as a result of its motion represents both a strong indicator of its flight velocity as well as a suitable source of energy. The azimuthal orientation of the device as well as the angle of incidence of the flight path with the ground plane are, for practical consideration indetectable and must therefore be considered to be random in nature.

SUMMARY OF THE INVENTION

The present invention is concerned with providing a second event system for detonating a fuel-air-explosive (FAE) device by launching a plurality of SE packages into the FAE cloud. Each SE package is positioned in a launching tube with a positioning spring on the explosive side urging it toward the muzzle end which is sealed with a frangible cover. A gas inlet, which operates to pressurize the muzzle end of the tube, applies a velocity dependent force on the SE package opposite the spring force so that the SE package is accurately positioned within the tube thereby controlling the retrolaunch velocity and position within the FAE cloud at the time of explosion.

Accordingly, it is an object of the invention to provide a speed controlled second event launcher based on a variable position concept wherein the second event package is positioned within a launching tube in accordance with the interaction between the force from a spring on one side and velocity dependent pressure on the other side of the package.

Another object of the invention is to provide a second event variable position launcher wherein the SE packages can be launched in a wide velocity range within the very short launch time available for the detonation of the FAE cloud.

Still another object of the invention is to provide a speed controlled second event launcher which is suitable for attachment to a fuel-air-explosive device for the purpose of detonating the FAE cloud by sensing the flight velocity at its terminal or impact point and launching the SE packages at the proper time and velocity.

A further object of the invention is to provide a high explosive launcher system for the second event detonation of an FAE cloud wherein the SE package is launched from a tube. The SE package is held in equilibrium between a spring and velocity dependent control pressure which effectively controls the position of the package in the tube and thereby controls the launch velocity and location at the time of detonation.

A still further object of the invention is to provide a speed controlled system for launching a second event package. The system is very compact and, therefore, easily attachable to the rear of all sizes of FAE devices within the fin fairing without interference with the control mechanism of the FAE device.

These and other objects, features and advantages will become more apparent after considering the following detailed description taken in conjunction with the annexed drawings and appended claims.

DESCRIPTION OF A PREFERRED EMBODIMENT

Figure 1:
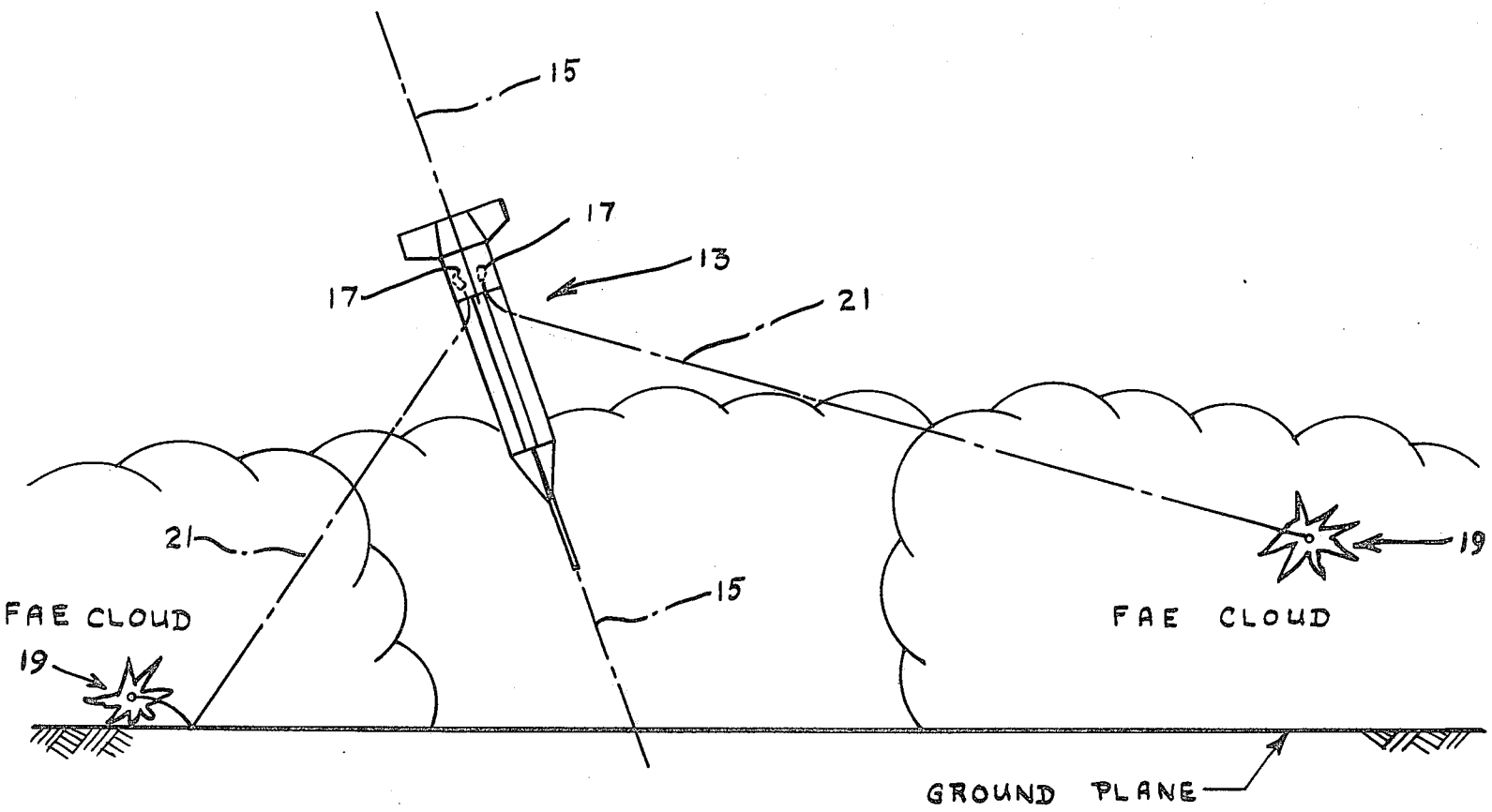
FIG. 1 is a general view illustrating the basic concept of a fuel-air-explosive (FAE) system showing the FAE cloud which forms after the fuel container has burst thereby distributing and mixing the fuel with air in the area.

Referring now to the drawings, FIG. 1 illustrates the fuel-air-explosive (FAE) device 13 which disperses fuel to form a large detonable FAE cloud. The cloud will generally have a central hole along the line of flight 15 of the FAE device 13 while the cloud itself forms in a distorted torus shape which is further locally distorted by the ground plane. The relative size and final shape of the FAE cloud will depend upon many variables including the terminal aerodynamics of the FAE device 13 and the proximity to the ground plane at the time of the burster charge detonation which forms the cloud.

After the dynamic FAE cloud is formed, it must be detonated by causing one or more explosions to take place within the boundaries of the cloud. This explosion is called the second event (SE) as distinguished from the burster charge which originally caused the FAE cloud to be formed. The specific requirements of the second event explosion are determined by the size, delay and spatial position of the FAE cloud. In the view of FIG. 1, a plurality of variable position speed controlled second event launchers 17 are attached to the rearward end portion of the FAE device 13. The launchers 17 effectively deploy one or more SE packages 19 into the FAE cloud within the proper time frame causing the cloud to explode. Since the launchers 17 operate to accelerate the SE packages 19 along a fixed line of flight 21, the flight velocity and direction must be strictly controlled. The launching process must be accomplished during the time that the FAE device 13 is bursting and causing the FAE cloud to be formed and reach explosive conditions. Thus, it can be seen that the time element as well as the positioning of the SE packages 19 in the FAE cloud is extremely critical and varies with the flight velocity and incident angles of the FAE device 13.

Figure 2:
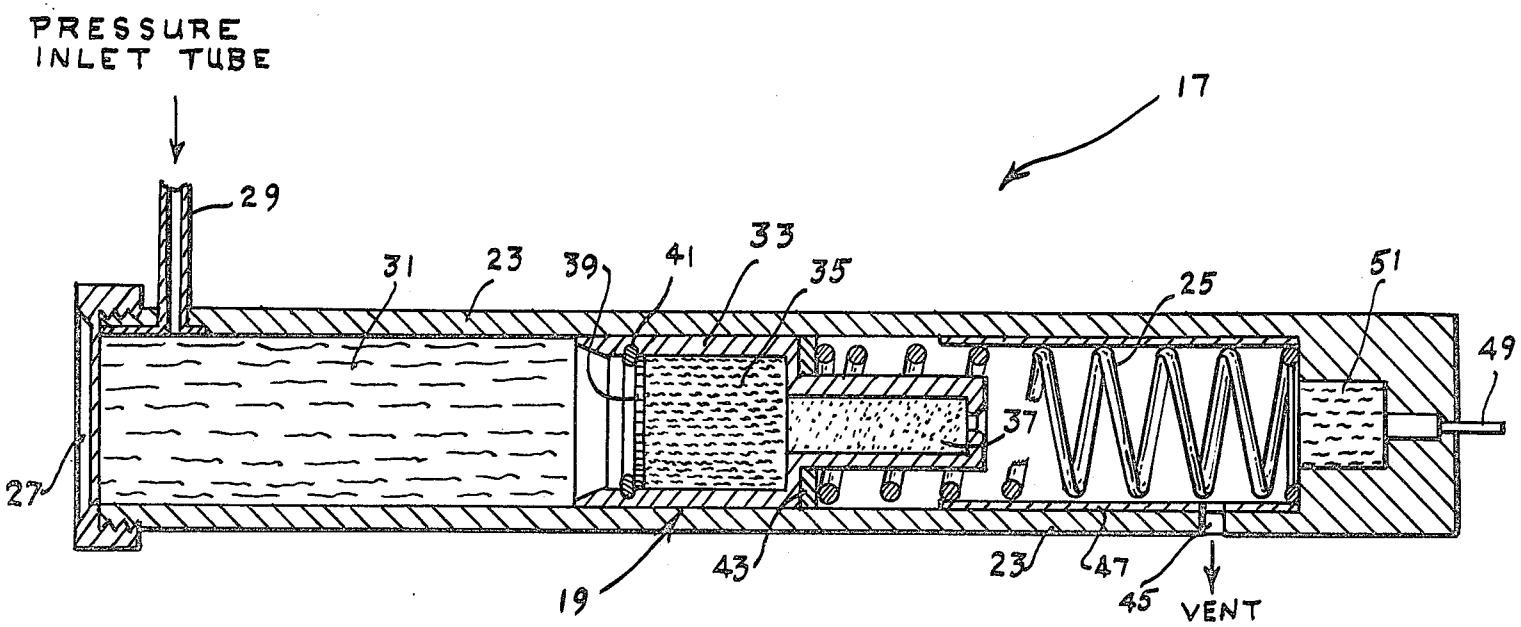
FIG. 2 is a side view in longitudinal cross section of a variable position launcher according to the invention showing the SE package in equilibrium in the launcher tube between the positioning spring and the pressurized muzzle end.

In FIG. 2, there is shown an enlarged detailed cross-sectional view of the variable position speed controlled second event launcher 17 according to the invention which includes a simple launch tube 23. The SE package 19 is positioned within the tube 23 with a positioning spring 25 on the explosive cavity side thereof urging the package 19 toward the muzzle end of the tube 23 which is sealed with a light diaphragm or frangible cover 27. A pressure inlet tube 29 is in operative communication with the muzzle end of the tube 23 and provides ram air to produce the pressurized gas 31 which applies a force to the SE package 19 against the force of the spring 25 placing the elements in equilibrium. The inlet tube 29 may be connected to a suitable source of pressurized control gas such as a pitot tube (not shown) so that the force applied to the SE package 19 is velocity dependent and thereby varies in proportion to the velocity of the FAE device 13.

The SE package 19 positioned in the launch tube 23 includes a case 33 preferably fabricated of aluminum or some similar material. The case 33 includes a larger forward section in which the SE explosive 35 is disposed and a smaller rearward section in which a delay unit 37 is positioned. A cover disc 39 held in position by a snap ring 41 operates to retain the SE explosive 35 in the case 33. A light seal 43 is affixed to the back surface of the larger forward section of the case 33 and makes sliding contact with the inner wall surface of the launch tube 23.

The light seal 43 operates to control the amount of leakage of pressurized gas 31 past the SE package 19 caused by the clearances and size tolerances required to provide substantially friction free movement of the SE package 19. Any gas leakage will obviously affect the pressure differential across the SE package 19 and hence, the positioning accuracy of the system. Since gas may flow past the seal 43 into the explosive cavity end of the tube 23, a vent 45 is provided so that any gas leakage will not change the reference pressure on the spring side of the SE package 19. A stop or spacer 47 is positioned inside the explosive cavity end of the launcher tube 23 to limit the rearward movement of the SE package 19 therein. A firing pin 49 operates to cause the launching explosive 51 to be detonated at the proper time when the SE package is in the proper position in the launch tube 23.

Thus it can be seen that a high explosive launcher system has been described which solves the critical second event of an FAE device detonation by effectively detonating the gas cloud within the very critical time period required. The variable position speed controlled second event package launcher detonation system solves the high speed delivery problem by providing a cloud detonator concept that functions over a wide range of impact velocities thereby allowing a wider range of delivery conditions and accuracy of the FAE system.

Although the invention has been described in the foregoing specification and illustrated in the accompanying drawings in terms of a preferred embodiment thereof, the invention is not limited to this embodiment or to the preferred configuration mentioned. It will be apparent to those skilled in the art that my invention could have extensive use in other operations where it is desirable to propel a plurality of explosive packages at a controlled velocity in a predetermined scatter pattern.

Having thus set forth the nature of my invention, what I claim and desire to secure by Letters Patent of the United States is:

1. A speed controlled variable position launcher system for deploying a high explosive second event package in a detonable fuel-air-explosive (FAE) cloud formed after the bursting of an FAE device, said variable position launcher comprising, an elongated hollow launch tube for attachment to the FAE device, said launch tube having an explosive cavity at one end and a muzzle at the other end, an explosive charge positioned in the explosive cavity of said launch tube, a second event (SE) package slidably positioned in the central portion of said launching tube, a positioning spring disposed in said launch tube between said SE package and the explosive cavity end, said spring operating to urge said SE package toward the muzzle end of said launch tube, a pressure tight frangible cover positioned over the muzzle end of said launch tube, and means for pressurizing the area between said SE package and the muzzle end of said launch tube such that the position of the SE package is dependent on the relationship between the forces exerted by the pressure and by the positioning spring thereby positioning the SE package in a predetermined location in the launch tube to allow launching at the proper velocity and cause the FAE cloud to be detonated when the SE package explodes.

2. The speed controlled variable position launcher system defined in claim 1 wherein said second event (SE) package includes, a case having a larger forward section and a smaller rearward section, SE explosive disposed in the larger forward section of said case, a delay unit positioned in the smaller rearward section of said case, a cover disc over the forward section of said case for retaining the SE explosive therein, means for sealing the area between said second event package and the inner wall of said launch tube to prevent pressurized gas leakage between the muzzle area and the explosive cavity end thereby preventing the gas pressure from affecting the biasing pressure on the spring side of the SE package.

3. The speed controlled variable position launcher system defined in claim 2 wherein a vent is provided in the wall of the launch tube near the explosive cavity end, said vent operating to prevent pressure increase caused by leakage past the sealing means.

4. The speed controlled variable position launcher system defined in claim 2 wherein said means for pressurizing the area between said SE package and the muzzle end of said launch tube includes a pressure inlet tube in the wall of said launch tube near the muzzle end thereof, said inlet tube being in operative communication with a velocity dependent source of ram air pressure from the FAE device, said pressure varying in proportion to the velocity of the FAE device.

* * * * *